United States Patent [19]

Hischke

[11] Patent Number: 4,679,256

[45] Date of Patent: Jul. 14, 1987

[54] MULTI-SIZE JUMPER DRESS

[75] Inventor: Marcia Hischke, Chicago, Ill.

[73] Assignee: Uniforms To You & Company, Chicago, Ill.

[21] Appl. No.: 922,455

[22] Filed: Oct. 23, 1986

[51] Int. Cl.[4] ..... A41D 1/22

[52] U.S. Cl. ..... 2/105; 2/76

[58] Field of Search ..... 2/74, 75, 105, 76, 69

[56] References Cited

U.S. PATENT DOCUMENTS 2,729,822 1/1956 Arkin ..... 2/76

2,757,380 8/1956 Fox ..... 2/76

*Primary Examiner*—Doris L. Troutman

*Attorney, Agent, or Firm*—Lockwood, Alex, FitzGibbon & Cummings

[57] ABSTRACT

A wrap-around jumper dress adapted to fit a plurality of different female figures having height, waist, bust and hip measurements within predetermined ranges of these measurements between small and large. The ability for a garment to fit a wide variety of female shapes and sizes results from a particular combination of garment components assembled in a particular relationship and actuated by pulling the tab ends of the waistband toward each other at the wearer's back and then securing the tab ends in place with buttons or other securing means.

3 Claims, 11 Drawing Figures

MULTI-SIZE JUMPER DRESS

This invention relates, generally, to a garment in the form of a wrap-around jumper dress adapted to fit a plurality of different females figures having height, waist, bust and hip measurements varying within predetermined ranges of these measurements between small and large. Thus, a single garment of this type will fit female figures ranging in size from 6 to 10 while another garment will fit sizes 12–16. An individual female figure within such nominal sizes will have height, waist, bust and hip measurements, some or all of which may be quite different (e.g. some smaller and some larger) from the same measurements of another female figure of the same nominal size. Nevertheless, a garment made in accordance with this invention will fit both individuals.

It is customary for restaurants to provide their waitresses with matching uniforms. A similar practice exists with respect to airline stewardesses, female bank employees, rent-a-car representatives, etc. Where such practices or customs exist, it would be desirable for the proprietors or operators thereof to minimize the inventory of uniforms required in order to provide their female personnel with neatly fitting garments or uniforms. Likewise, it would be desirable for dress manufacturers and firms in the wholesale and retail garment business to be able to offer a garment that will neatly fit a range of sizes and shapes of female customers so as to thereby minimize the stock or inventory of a particular garment which has to be maintained.

The present invention provides such a multi-size garment in the form of a wrap-around jumper dress. The garment is formed by a top half and a lower skirt joined together by a waistband that buttons or is otherwise secured in the back. The skirt comprises three separate pieces or panels including a middle panel and a pair of side panels. One vertical side edge of each side panel is joined or seamed to one of the opposite vertical edges of the middle panel leaving the other side edge of the side panel free. When worn, the middle panel will cover a wearer's rear side below her waist and usually at least a portion of the wearer's opposite sides or hips below her waist. The free side portions of the side panels are adapted to overlap each other (usually the right front over the left front) so as to at least cover the wearer's front side below the waist.

The upper half of the garment comprises a wearer's back panel and a pair of chest or bodice panels. The wearer's back panel has a generally horizontal bottom edge and a pair of spaced shoulder edges interconnected by a curved back-of-the-neck edge. Each of the chest panels has an upper shoulder edge joined to a shoulder edge of the back panel and a lower edge which extends down to the top edge of the adjacent side panel of the skirt. The upper half of the garment and the skirt half are interconnected or joined to a waistband of sufficient length so as to have free tab ends which can be secured together at the wearer's back. Preferably, the back of the waistband is provided with a row of buttons and the ends of the tabs will have button holes which fit over the buttons depending upon the wearer's waist measurement.

The waistband of the garment will have a vertical slot through which one of the tab ends may be passed or threaded. In addition, loops will be provided at the opposite ends of the row of buttons for alignment of the tab ends.

The foregoing components of a garment made in accordance with the present invention will be so shaped, sized and joined together that when applied to a wearer's figure the garment will more or less adjust itself at the pressure points or protuberances so as to provide a neat appearing fit on the wearer.

From the foregoing it will be apparent that a primary object of the invention is the provision of a dress or garment that will fit a relatively wide range of female figures having height, waist, bust and hip measurements which are considerably different.

A further object of the invention is the provision of a garment or dress of the foregoing type which can be economically produced on a production basis using modern garment-making techniques and equipment.

Certain other objects of the invention will be obvious and appear hereinafter in view of the following detailed description of a presently preferred embodiment of the invention taken with the accompanying drawings, wherein.

Figure 3:
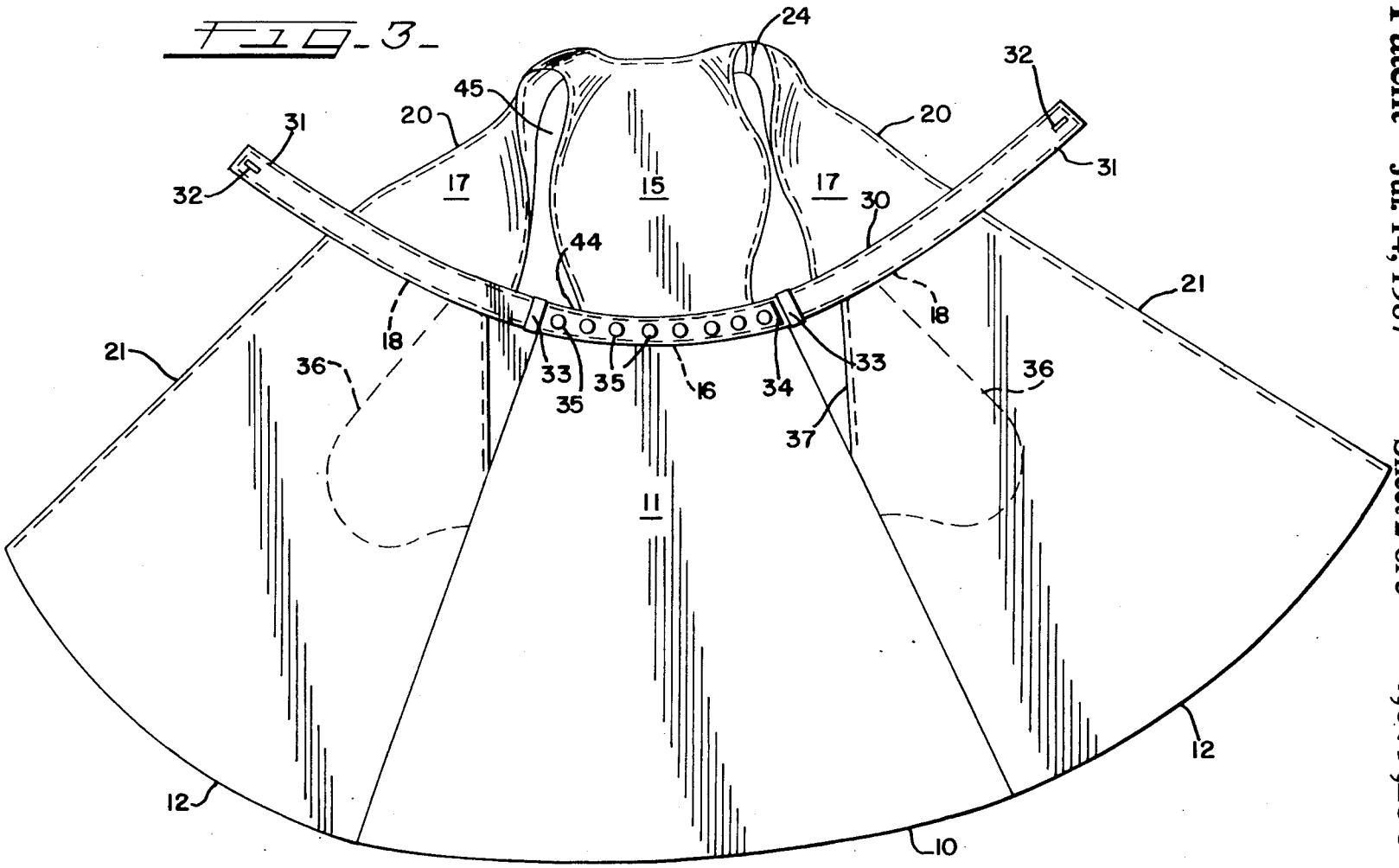
FIG. 3 is a view of the jumper dress of FIG. 1 laid out in open or flat condition with the outer side of the garment showing.
Figure 4:
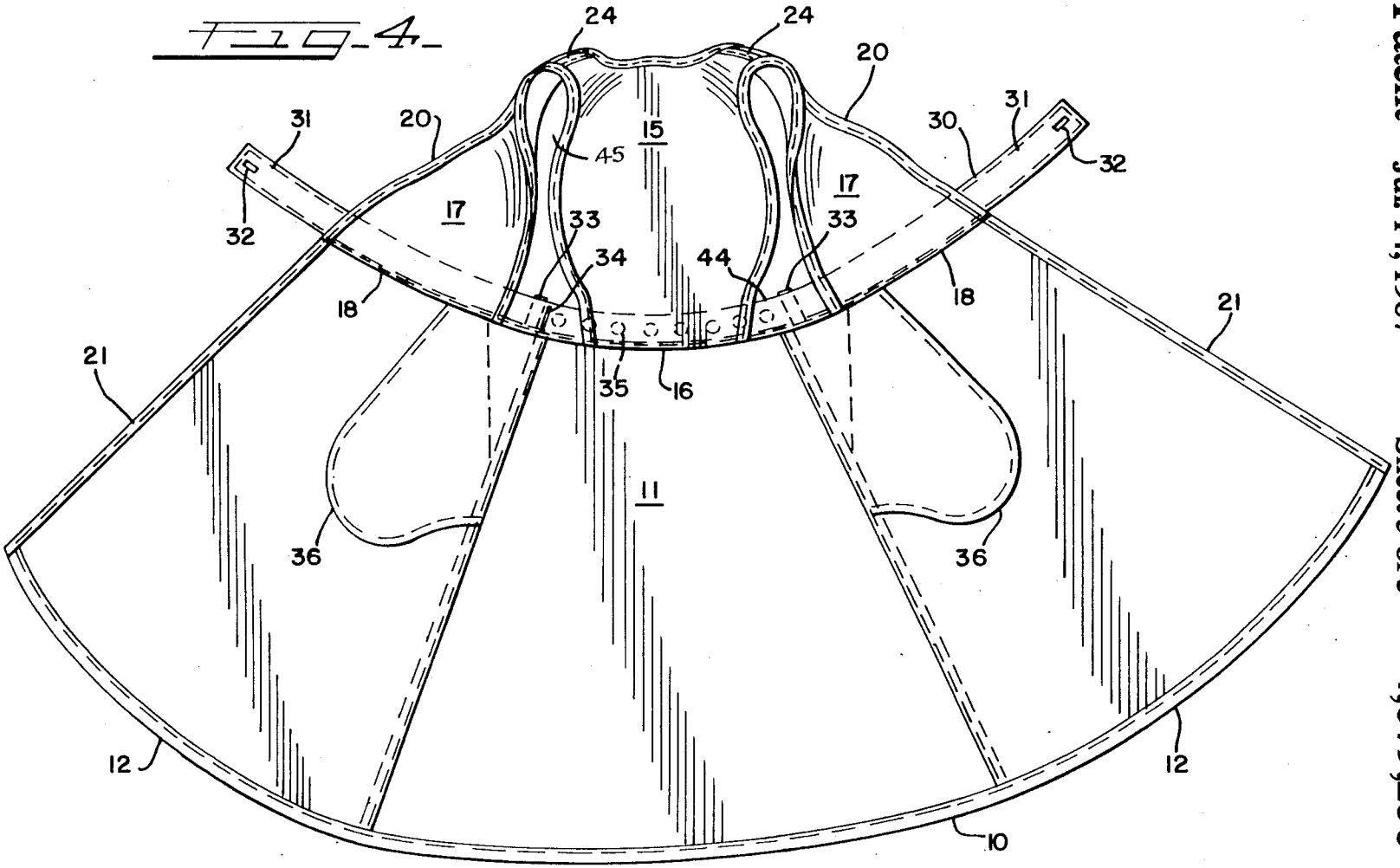
FIG. 4 is a view corresponding to FIG. 3 but showing the opposite or inside of the garment in laid out or flattened condition.

Referring primarily to FIGS. 3 and 4 it will be seen that the middle panel 10 of the skirt indicated generally at 11 is joined to side panels 12—12. The joinder is made by seaming together the generally vertical edges 13—13 of the middle panel 10 to one edge 14 of each of the side panels 12.

Figure 5:
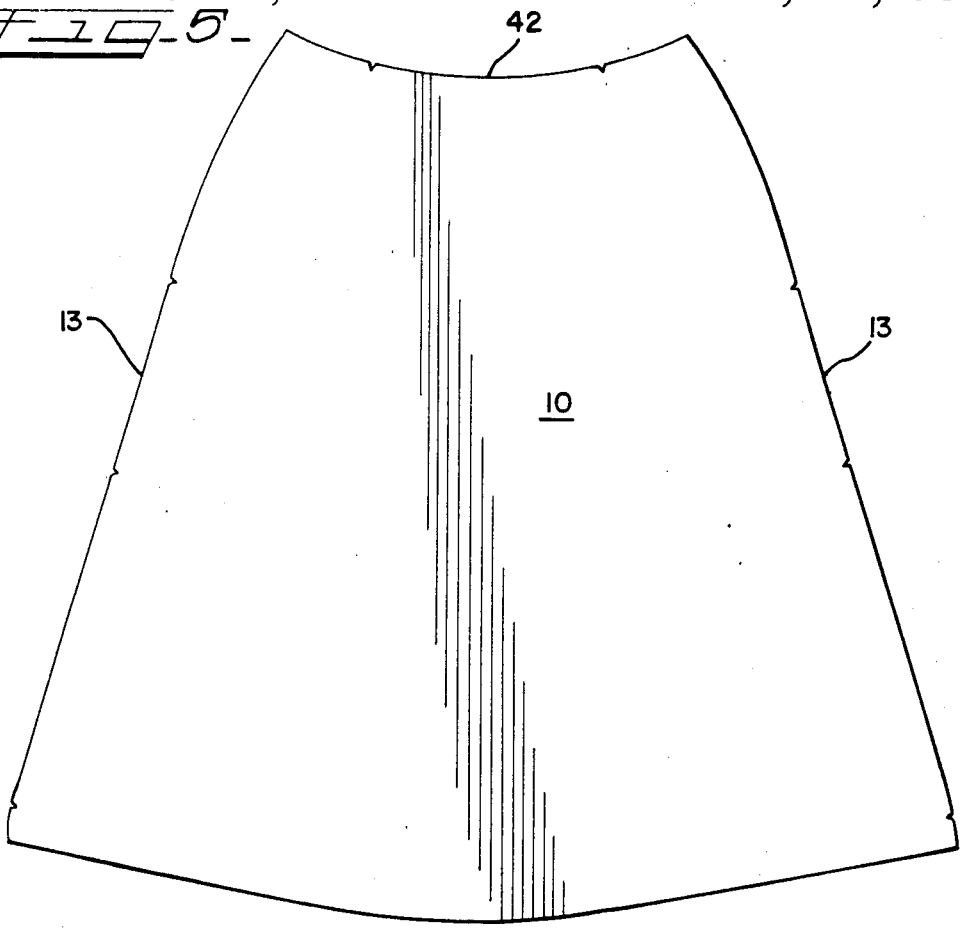
FIG. 5 is a view of the middle panel of the skirt of the garment shown in FIGS. 1–4.
Figure 8:
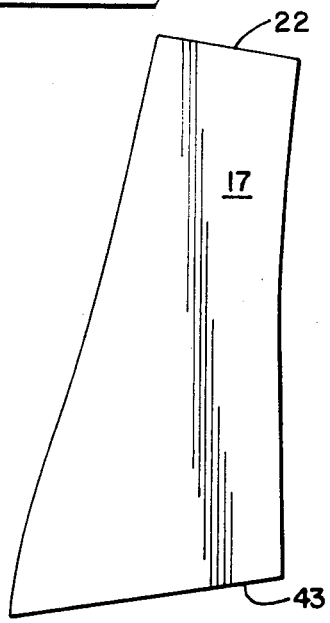
FIG. 8 is a view of one of the two chest panels forming the front side of the garment shown in FIGS. 1–4.
Figure 6:
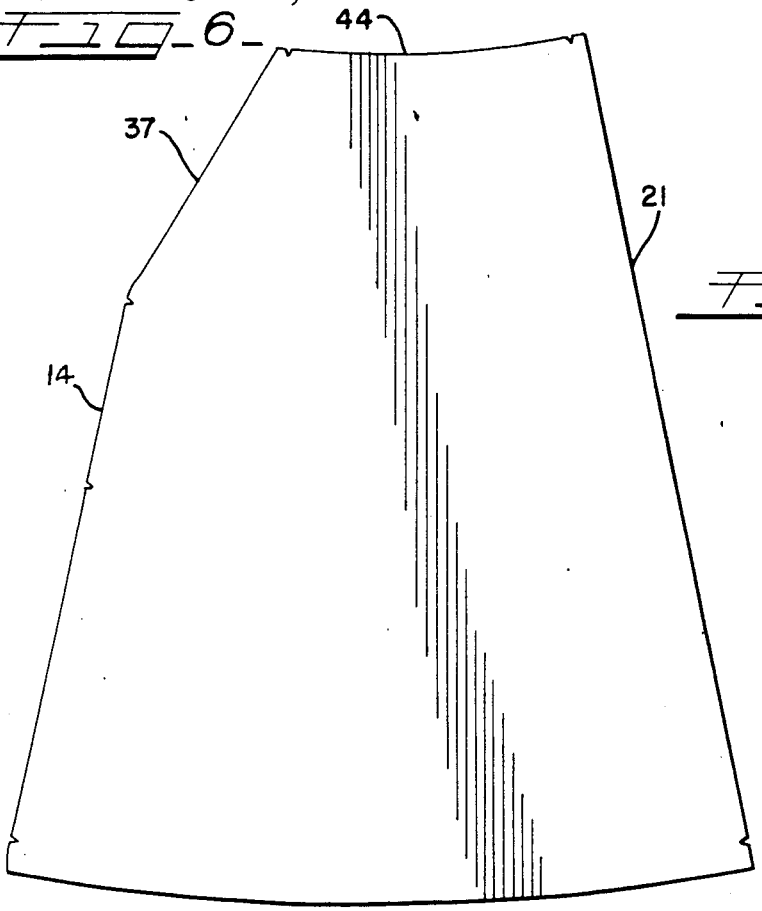
FIG. 6 is a view of one of the two side panels of the skirt of the garment shown in FIGS. 1–4.
Figure 11:
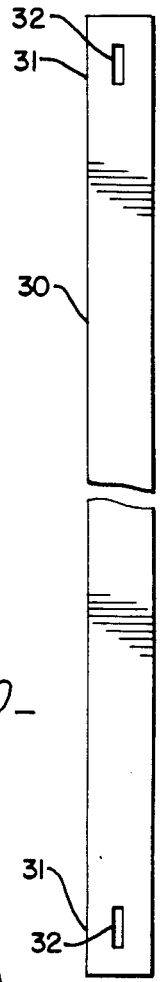
FIG. 11 is a view, partly broken away, of the waistband utilized in joining or attaching the upper portion top half of the garment shown in FIGS. 1–4 to the skirt portion.
Figure 7:
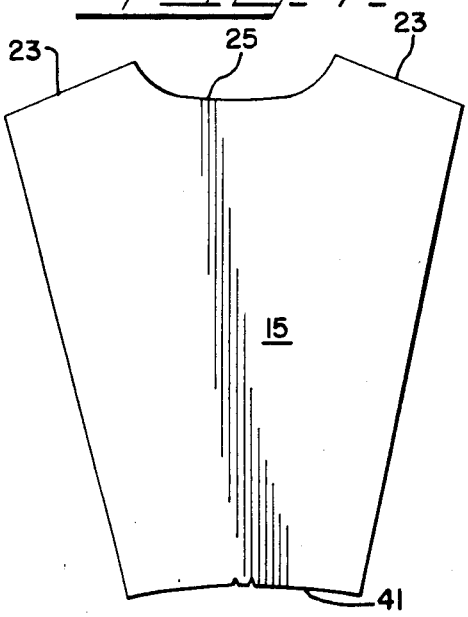
FIG. 7 is a view of the wearer's back panel of the garment shown in FIGS. 1–4.

As best shown in FIG. 4 the upper edge 42 (FIG. 5) of the middle panel 10 is seamed to the generally horizontal bottom edge 41 (FIG. 7) of the wearer's back panel member 15 as indicated at 16 (FIG. 4) while the upper edges 44 (FIG. 6) of the side panels 12—12 are joined to the lower edges 43 (FIG. 8) of the chest panels 17—17 at seams indicated at 18—18 (FIG. 4). It will be noted that the outer edges 20—20 (FIG. 4) of the chest panels 17 form extensions of the free or outer edges 21—21 of the side panels 12.

The upper edges 22 of the chest panels 17—17 which are generally horizontal are joined to the upper and spaced shoulder edges 23—23 of the back panel 15 by seams indicated at 24—24. The shoulder edges 23—23 of the back panel 15 are spaced apart and separated by a back-of-the-neck edge 25.

The waistband 30 is preferably made in two thicknesses of material and has a sufficient length so as not only to join together the upper and lower portions of the garment 11 but also to have free tab ends 31—31 which are provided with button holes 32—32. The bottom edge of the waist band 30 is co-joined to the middle panel 10 and side panels 12 of the skirt and to the bottom or lower edges of the wearer's back panel 15 and the chest panels 17 of the upper or bodice portion of the garment. The upper edge of the waistband 30 is seamed to the chest panels 17 and wearer's back panel 15. In this manner the waistband 30 effectively mechanically or operatively interconnects the skirt 11 with the top half comprised of the chest panels 17—17 and to the back panel 15.

Referring to FIG. 3, it will be seen that the waist band 30 is provided with a pair of loops 33—33 and also a slot 34. The waistband is also provided with a row of buttons 35—35.

Preferably the garment is provided with pockets which are indicated generally at 36—36. Each of the edges 14 of the side panels 12 is beveled as indicated at 37 to provide a hand receiving opening into each pocket 36.

Figure 9:
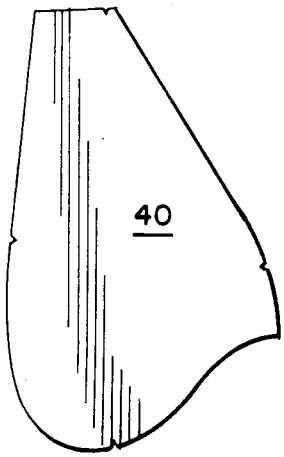
FIG. 9 is a view of one of the patches used in forming one of the two pockets of the garment shown in FIGS. 1–4.
Figure 10:
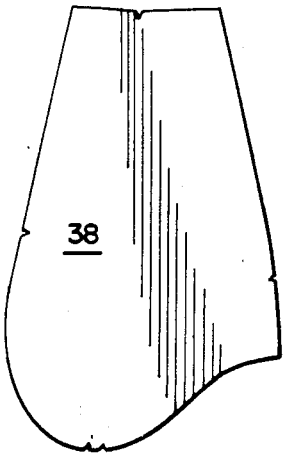
FIG. 10 is a view of the other patch used in forming a pocket.

The pocket patches 38 (FIG. 10) form the insides of the pockets which lie next to the wearer's body while the patches 40 (FIG. 9) provide the portions of the pocket which are intermediate between the patches 38 and the inner side of the material forming the side panels 12. These pockets 36 are formed in well known manner.

It is important to note that the width of the lower edge 41 of the back panel 15 is appreciably less than the width of the upper edge 42 of the skirt middle portion 10. In the same connection, the bottom or lower edge 43 of each chest panel 17 is appreciably shorter than the upper edge 44 of the side panels 12. By virtue of these relative dimensions spaces or gaps 44—44 are left between the bottom of the back panel 15 on each side and the adjacent chest panels 17. These spaces allow for the arm openings 45—45 which permit the wearer to don the garment and freely move her arms. Furthermore, the relationship and relative dimensions of the mating edges of the back panel 15 and middle skirt panel 11 and the mating edges of the chest panels 17 and the side panels 12 coact to distribute the tension applied to the waistband 30 so that the garment adjusts itself to the dimensions of the particular wearer.

The wearer puts on the garment by inserting the left and right arms into the left and right arm openings 45. The left side panel of the skirt is then wrapped across the front of the wearer's body and the left tab 31 as shown in FIG. 3 (right tab 31 as shown in FIG. 4) is then inserted through the slot 34 in the waistband 30 and temporarily left free while the right front of the jumper is brought across the wearer's left front. The right waistband tab 31 as shown in FIG. 3 (left tab 31 as shown in FIG. 4) is then brought around and passed through the left loop 33 (FIG. 3). Now the wearer pulls each tab 31 towards the other to the rear and the tabs are buttoned to retain the waistband with the desired degree of tension to the buttons 35. It is this pulling action on the tabs of the waist band at the rear of the garment on the midriff that serves to automatically adjust the garment to the wearer's figure. During this adjustment action excess body fabric from the front is equally relocated on each side toward the rear. The waistband 30 serves to retain the excess fabric neatly in place to each side of the garment.

Figure 1:
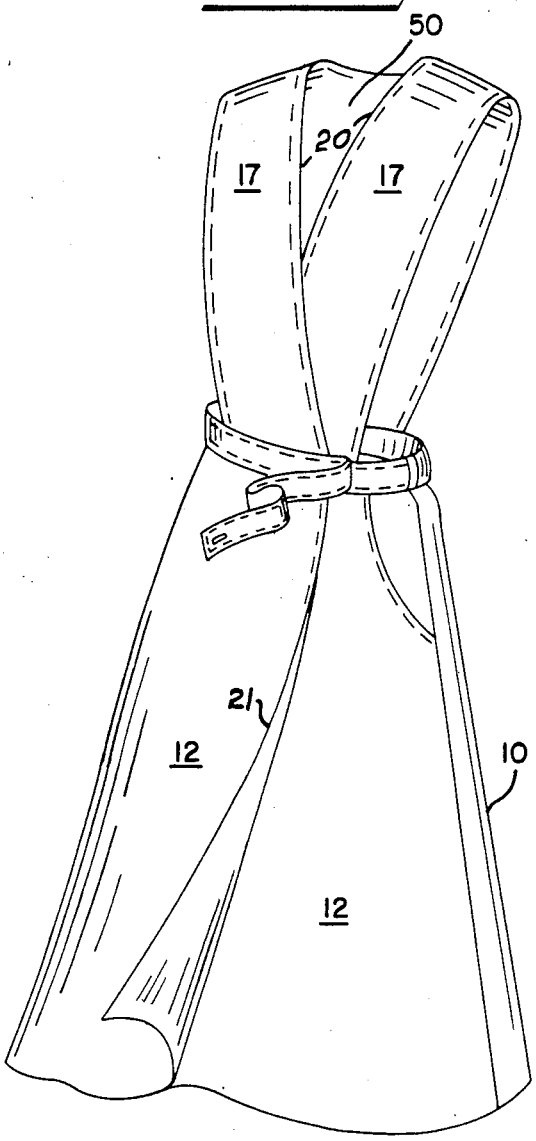
FIG. 1 is a front perspective view of a garment embodying the present invention with the garment being in the condition it takes on a wearer before the right front is fully overlapped over the left front and with one end of the waistband tab free before being secured to the buttons in the back.
Figure 2:
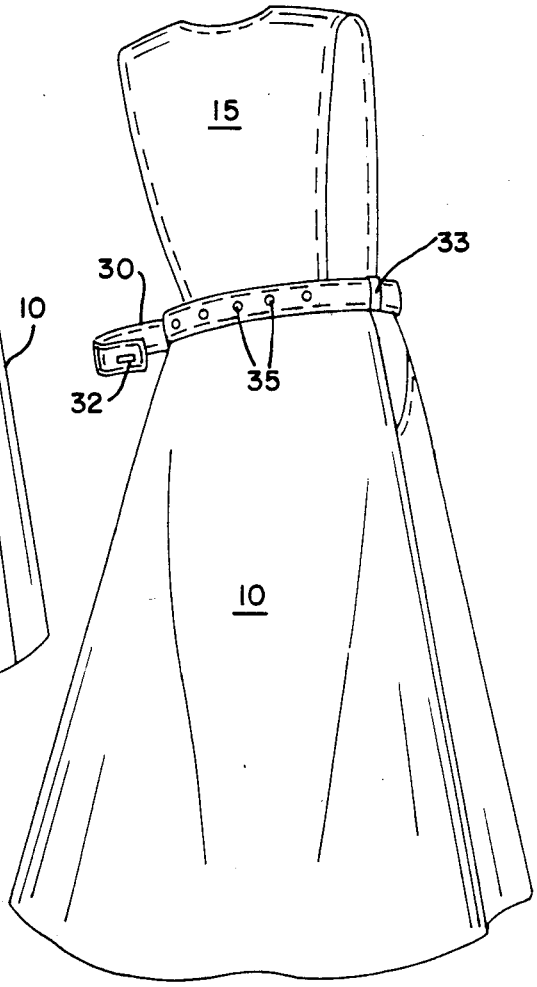
FIG. 2 is a rear view of the garment shown in FIG. 1.

Referring to FIG. 1 it will be seen that the chest panels 17 form a V-opening 50. By making the panels 17 of a suitable width, the depth of the V-opening 50 will be appropriate for the figures of wearers of various sizes within the nominal ranges the garment accommodates.

It will be apparent that the garment shown and described in connection with FIGS. 1–11 may be modified in respect to details without departing from the spirit and scope of the invention. For example, while buttons and button holes are the preferred means for securing the tabs 31 of the waistband 30 in place, snaps or Velco fasteners could be used as alternatives.

What is claimed is:

1. A wrap-around jumper dress adapted to fit a plurality of different female figures having height, waist, bust and hip measurements varying within predetermined ranges of these measurements between small and large, and comprising, in combination:

a skirt, a wearer's back panel, a pair of chest panels, and a waistband;

said skirt being formed by a middle panel and a pair of side panels joined at one side edge of each to opposite edges of said middle panel, said middle panel covering a wearer's rear side below the waist and at least a portion of the opposite sides of a wearer below the waist, and the unattached side portions of said side panels being adapted to overlap each other and at least cover the wearer's front side below the waist;

said wearer's back panel having a generally horizontal bottom edge and a pair of spaced shoulder edges interconnected by a back of-the-neck edge;

each of said chest panels having an upper edge joined to one of said back panel's shoulder edges and a lower edge which extends down to adjacent the top edge of the adjacent side panel;

said waistband being joined to the upper edges of said middle and side panels and to the bottom edge of said wearer's back panel and said lower edges of said chest panels, and said waistband having tab-like extensions on its opposite ends adapted to extend to behind a wearer's back side and be releasably secured to the back of the dress at the waist; and the act of drawing of said tab-like extensions snugly toward each other causing said dress to adjust itself to the shape, size and form of said wearer in respect to the wearer's particular height, waist, bust and hip measurements.

2. The jumper dress called for in claim 1 wherein:

the width of the said chest panels is sufficient to cover the chest of the wearer while leaving a V-neckline;

the width of the lower edge of each chest panel is substantially less than the width of the adjacent upper edge of the adjacent of said side panels and the upwardly extending overlapping edge of each said chest panel forms an extension of the upwardly extending edge of said free side portion of the adjacent side panel;

the width of said bottom edge of said wearer's back panel being substantially less than the width of the adjacent upper edge of said middle panel; and the space between adjacent edges of said chest panels and said wearer's back panel providing space for the wearer's arms.

3. The jumper dress as called for in claim 1 wherein the intermediate exposed portion of said waistband extending approximately between the upper corners of said middle panel is provided with fastener means;

said tab-like extensions on said waistband having means whereby said extensions can be secured to said fastener means;

said waistband having at least one slot adjacent one end of said intermediate exposed portion to receive therethrough one of said tab-like extensions; and said waistband having at least one loop adjacent the end of said intermediate exposed portion opposite said first-mentioned one end for receiving therethrough the remaining on of said tab-like extensions.

* * * * *